US006554045B1

(12) United States Patent
Lee

(10) Patent No.: US 6,554,045 B1
(45) Date of Patent: Apr. 29, 2003

(54) FILM-TAPE ERASER WITH NORMALLY RETRACTED DISPENSING HEAD

(75) Inventor: James Lee, Taipei (TW)

(73) Assignee: Chong-Z International Co., Taipei (TW)

( * ) Notice: Subject to any disclaimer, the term of this patent is extended or adjusted under 35 U.S.C. 154(b) by 0 days.

(21) Appl. No.: 10/020,154

(22) Filed: Dec. 18, 2001

(51) Int. Cl.[7] ..... B32B 31/00

(52) U.S. Cl. ..... 156/577; 156/523; 156/579; 118/76; 242/160.4; 242/171; 242/588.6

(58) Field of Search ..... 156/238, 523, 156/527, 540, 574, 577, 579; 225/46; 242/160.2, 160.4, 170, 171, 588, 588.2, 588.3, 588.6; 118/76, 200, 257

(56) References Cited

U.S. PATENT DOCUMENTS 3,850,779 A * 11/1974 Pearson ..... 156/523
4,097,328 A * 6/1978 Urushizaki ..... 156/523
4,792,375 A * 12/1988 Lin ..... 156/510
5,316,613 A * 5/1994 Samuelson et al. ..... 156/540
5,326,421 A * 7/1994 Taylor ..... 156/526
6,053,233 A * 4/2000 Lin ..... 156/523

FOREIGN PATENT DOCUMENTS

TW 88213471 8/1999

* cited by examiner

*Primary Examiner*—Mark A. Osele
(74) *Attorney, Agent, or Firm*—Rabin & Berdo, P.C.

(57) ABSTRACT

A film-tape eraser with normally retracted dispensing head includes an upper case, a lower case, and a dispensing mechanism pivotally connected to and located in the lower case. The upper case is also pivotally connected to the lower case to shield an upper part of the latter, while the dispensing mechanism is partially exposed from a top of the upper case. A downward push at a top of the dispensing mechanism would sink the dispensing mechanism and bring the dispensing head to a position exposed from a lower front of the lower case. When the dispensing mechanism is released from the downward push, an elastic strip at the bottom of the dispensing mechanism springs the dispensing mechanism up and brings the dispensing head to a retracted position in the lower case.

4 Claims, 9 Drawing Sheets

FILM-TAPE ERASER WITH NORMALLY RETRACTED DISPENSING HEAD

BACKGROUND OF THE INVENTION

1. Field of the Invention

The present invention relates to a film-tape eraser, and more particularly to a film-tape eraser with normally retracted dispensing head. A downward push at a top of the eraser would sink a dispensing mechanism of the eraser and bring a dispensing head to a position projected from a lower front of the eraser for use. When the downward push is released, the dispensing mechanism is elastically lifted and the dispensing head is retracted into the eraser.

2. Description of the Prior Art

Most of the conventional film-tape erasers do not include a cap, and are therefore subject to a damaged or deformed dispensing head when the erasers are unexpectedly dropped or impacted. A damaged or deformed dispensing head fails to dispense an erasing film-tape smoothly and continuously, and possibly becomes completely useless.

Even if a film-tape eraser initially includes a cap to protect the dispensing head against undesired damage or deformation, the cap tends to be ignored or discarded soon because it causes inconveniences to a user who has to remove and replace the cap each time the eraser is used.

Taiwanese Patent Application No. 88213471 discloses a film-tape eraser that includes a main body having a dispensing opening, an upper side of which is provided with an engaging part for a cap to pivotally connect thereto. The cap may be easily closed onto the dispensing opening to isolate the film-tape from an external environment and be easily lifted to expose the film-tape for use. Since the cap is pivotally connected to the main body of the eraser, it is protected against separating from the main body and becoming lost. However, the cap must be lifted each time the eraser is to be used. And, in the case the eraser is unexpectedly dropped with the cap in the lifted position, it is possible the cap is damaged and separated from the main body due to collision with the ground. Thus, the pivotally connected cap does not provide an effective solution to protect the dispensing head of the film-tape eraser.

It is therefore tried by the inventor to develop a film-tape eraser having a dispensing head that is normally retracted into the eraser and could be extended from the eraser for use simply by downward pushing a top of the eraser, so that the film-tape eraser is always protected against a damaged or deformed dispensing head.

SUMMARY OF THE INVENTION

A primary object of the present invention is to provide a film-tape eraser with a normally retracted dispensing head. When a downward push is applied at a top of the eraser, the dispensing head is moved to expose from a lower front of the eraser for use, and when the downward push is released, the dispensing head automatically retracts into the eraser and is protected against damage due to any undesired drop of or impact against the eraser.

Another object of the present invention is to provide a film-tape eraser having a dispensing mechanism that may be elastically lifted from a lower case of the eraser for replacement of a new erasing film-tape.

To achieve the above and other objects, the film-tape eraser of the present invention mainly includes an upper case, a lower case, and a dispensing mechanism pivotally connected to and located in the lower case. The upper case is also pivotally connected to the lower case to shield an upper part of the latter. The lower case has a curved bottom that serves as a slide way, and the dispensing mechanism is provided at a bottom with a forward extended elastic strip that is movably pressed at a front free end against the slide way of the lower case to normally elastically pushes the dispensing mechanism upward to partially expose from a top of the upper case.

A downward push at a top of the dispensing mechanism would sink the dispensing mechanism and bring the dispensing head to a position exposed from a lower front of the lower case. When the dispensing mechanism is released from the downward push, the elastic strip at the bottom of the dispensing mechanism springs the dispensing mechanism up and brings the dispensing head to a retracted position in the lower case.

The upper case is provided at two sidewalls near lower rear portions thereof with two locking holes for normally engaging with two locking studs projected from two release button provided on two sidewalls of the lower case. When the release buttons are inward pushed to disengage the locking studs from the locking holes, the upper case together with the dispensing mechanism are sprung up by the elastic strip at the bottom of the dispensing mechanism to locate above the lower case. A user may then remove an erasing film-tape from the dispensing mechanism and replace it with a new one.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
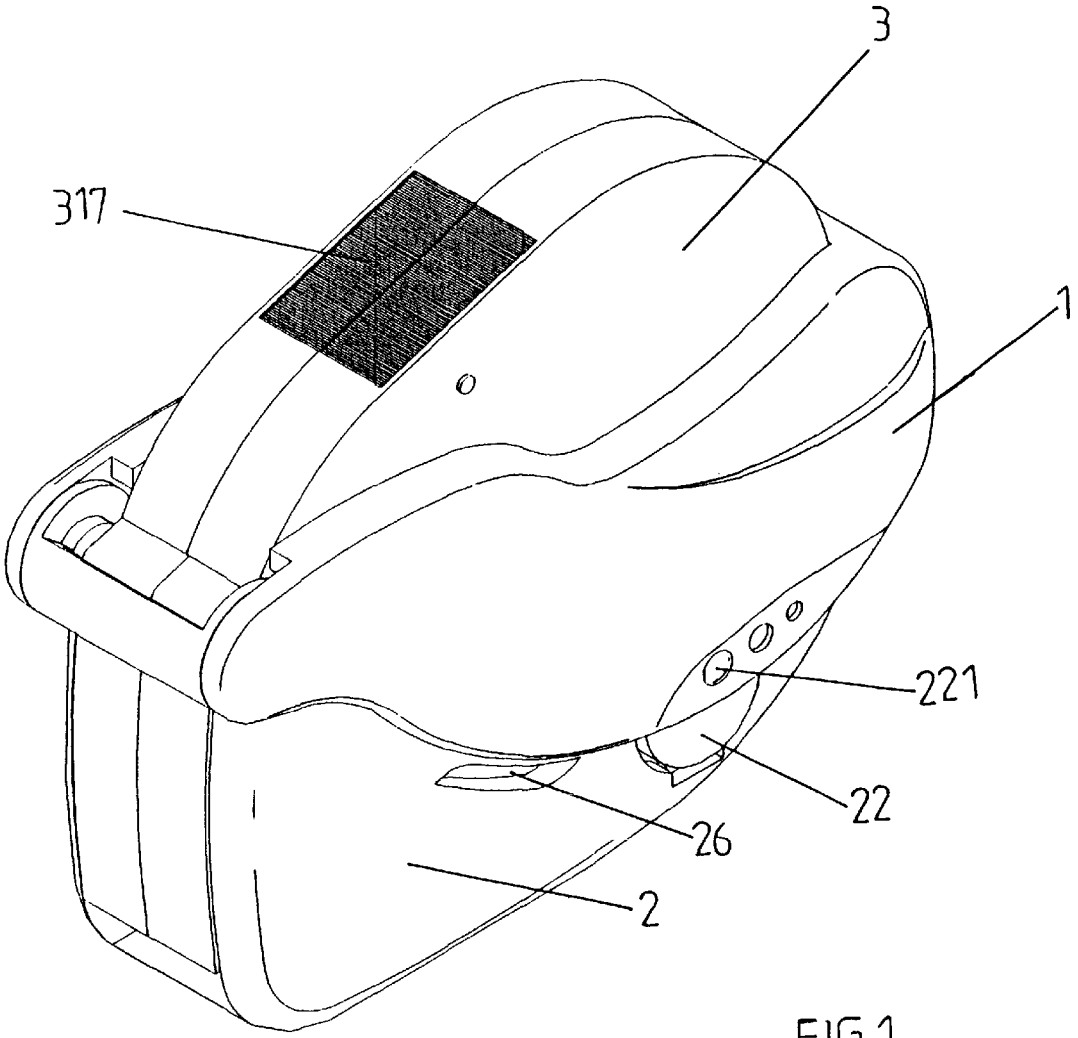
FIG. 1 is a front perspective view of a film-tape eraser according to a preferred embodiment of the present invention, wherein a dispensing head of the eraser is in a retracted position when the eraser is not in use.
Figure 3:
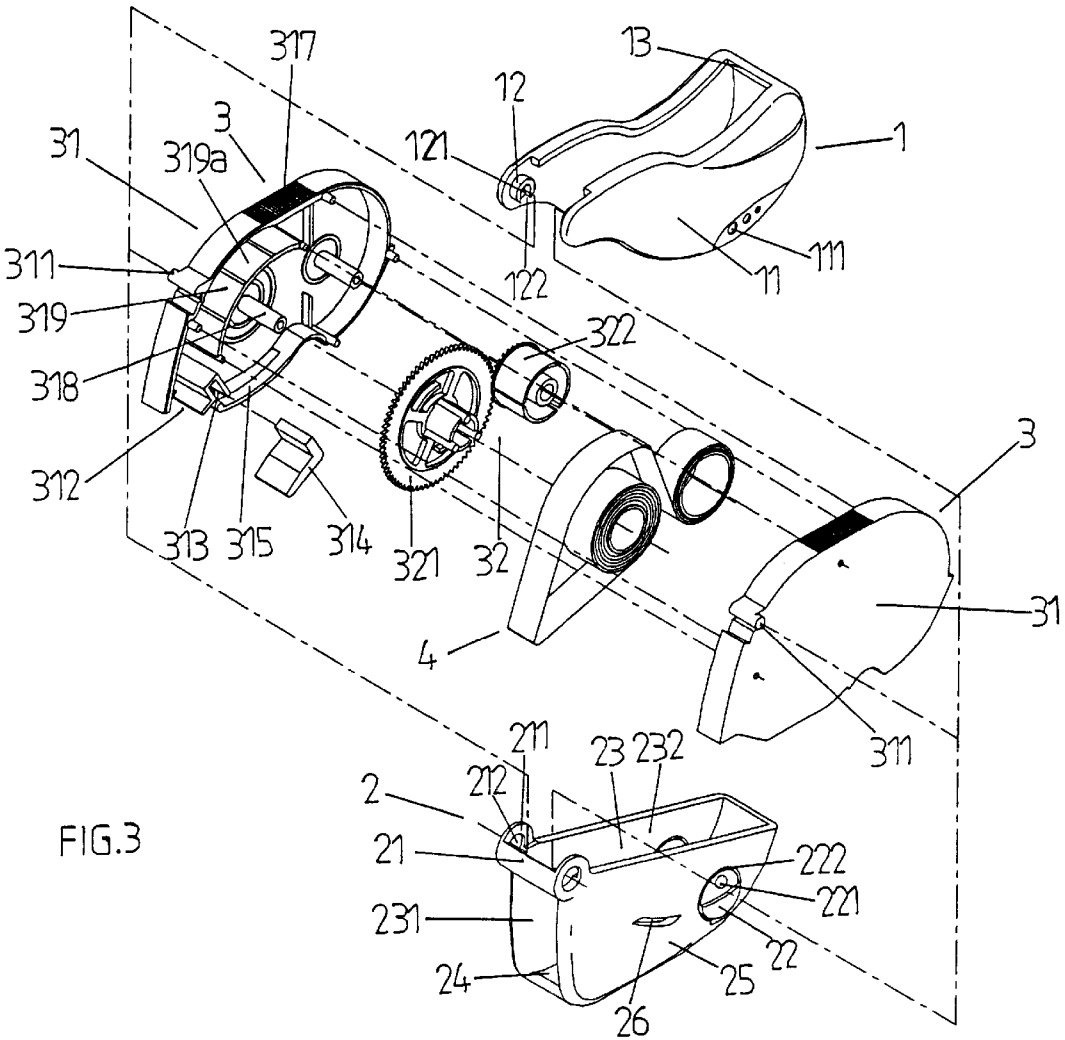
FIG. 3 is an exploded perspective view of the film-tape eraser of FIG. 1.

Please refer to FIG. 1 that is a front perspective view of a film-tape eraser with normally retracted dispensing head according to a preferred embodiment of the present invention, and to FIG. 3 that is an exploded perspective view of the film-tape eraser of FIG. 1. As shown, the film-tape eraser of the present invention includes an upper case 1, a lower case 2, a dispensing mechanism 3, and an erasing film-tape 4 mounted on the dispensing mechanism 3.

The upper case 1, as viewed from a top thereof, is an n-shaped hollow member having a rear wall and two sidewalls 11. Upper and lower edges of the two sidewalls 11 are designed into predetermined curves. The sidewalls 11 are provided near their respective lower rear portions with a row of holes, a first hole of which is a locking hole 111; and at their respective front inner ends with an inward projected pivot shaft 12. Each of the pivot shafts 12 is further provided with an open-bottomed pivoting hole 121 defining a lower opening 122. Moreover, the upper case 1 is provided at a top of the rear wall with a stopper 13 that extends toward an inner side of the hollow upper case 1.

The lower case 2 is a hollow case having a curved bottom 24 serving as a slide way and two sidewalls 25 to define a space 23 therein. The lower case 2 has a profile close to an inverted right-angled triangle to provide a front opening 231 and a top opening 232. A connecting part 21 extends across a joint of the front and the top opening 231, 232 to connect the two sidewalls 25. Two lateral ends of the connecting part 21 are formed into two shaft rings 211, each of which defines a shaft hole 212 for one of the pivot shafts 12 at the front inner ends of the upper case 1 to engage therewith, so that the upper case 1 is pivotally turnable relative to the lower case 2 to a lifted position to locate above and expose the lower case 2 or to a lowered position to shield an upper part of the lower case 2.

The two sidewalls 25 of the lower case 2 are provided near their respective rear ends with a round release button 22, which is integrally formed at a lower end with the sidewall 25 and bordered by a slit 222. A locking stud 221 is outward projected from an upper half of each release button 22. When the upper case 1 is turned to the lowered position to partially shield the lower case 2, the locking studs 221 are forced to engage into the locking holes 221; and when the release buttons 22 are inward depressed, the locking studs 221 are disengaged from the locking holes 221, allowing the upper case 1 to be turned to the lifted position. A window 26 may be provided on one of the sidewalls 25 near a front portion thereof for a user to observe the dispensing mechanism 3 moving in the lower case 2.

Figure 5:
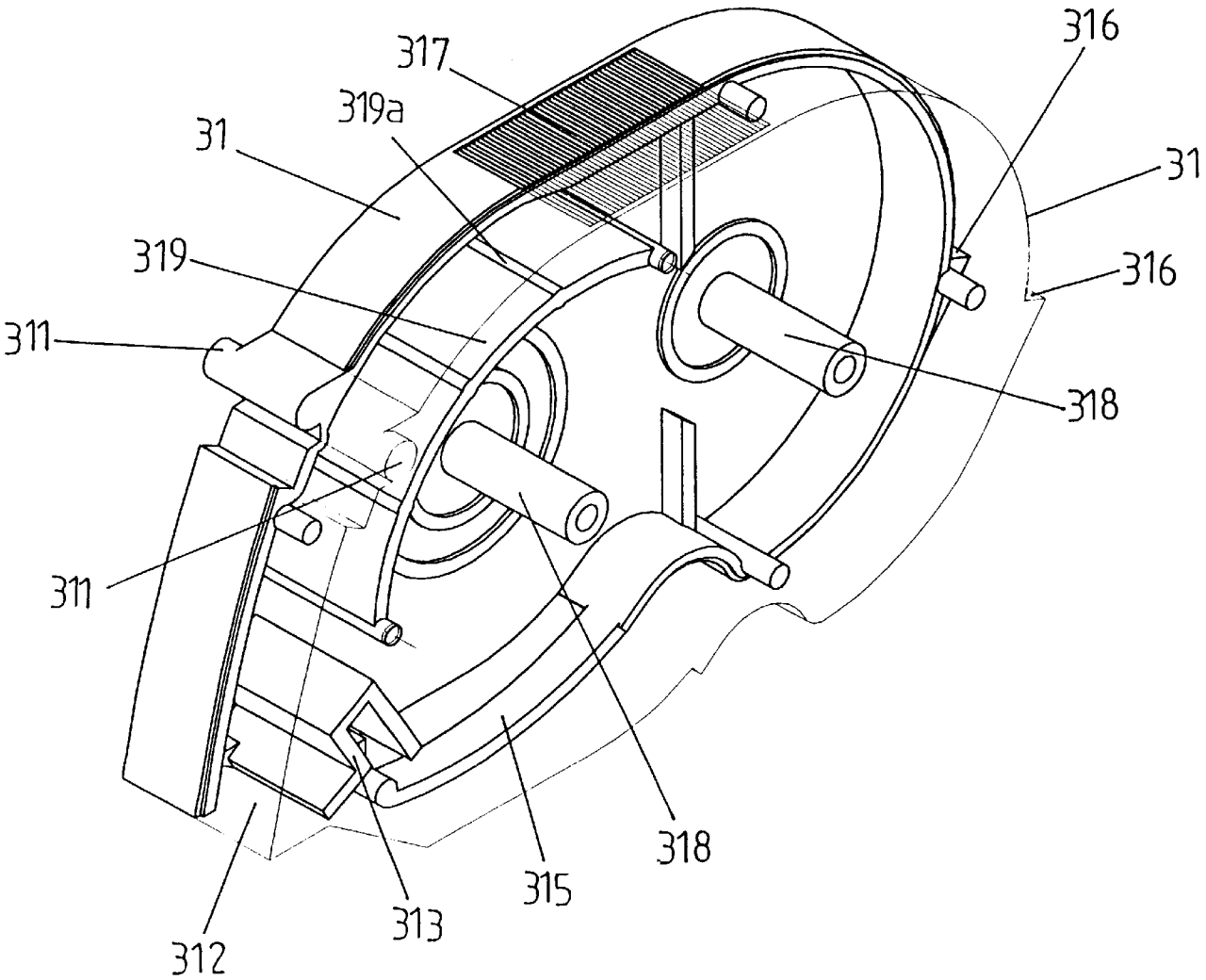
FIG. 5 is a front perspective view of a case of the dispensing mechanism of the present invention.

Please refer to FIG. 5 that is a front perspective view of one of two side cases 31 forming a part of the dispensing mechanism 3. The dispensing mechanism 3 includes a left and a right side case 31. The two side cases 31 are provided at their respective upper fronts with two outward projected shafts 311 that are adapted to pivotally position in the pivoting holes 121 via the lower openings 122, allowing the dispensing mechanism 3 to locate in the upper case 1 and the inner space 23 of the lower case 2. When the two side cases 31 are assembled to each other, a dispensing opening 312 is left at a lower front of the assembled side cases 31. A mounting channel 313 is provided behind the dispensing opening 312 for a dispensing head 314 to mount thereto. The dispensing head 314 is coated with a thin layer of Teflon that enables a smooth contact of the erasing film-tape 4 mounted on the dispensing mechanism 3 with the dispensing head 314 without becoming stuck or even broken due to any friction between the erasing film-tape 4 and the dispensing head 314.

The side cases 31 are partially provided at a top with a plurality of antislip lines 317, and at their respective inner sides at predetermined positions with inward projected front and rear mounting shafts 318, onto which a driving tape reel 321 and a driven tape reel 322 forming a film-tape driving mechanism 32 are respectively mounted. One of the side cases 31 is provided below its upper front portion with a longitudinally extended guide strip 319. Transverse ribs 319*a* are formed on a top surface of the guide strip 319, so that the erasing film-tape 4 mounted on the driving and the driven tape reels 321, 322 and passing the dispensing head 314 is guided through tops of the transverse ribs 319*a* to substantially float over the guide strip 319, enabling stable and smooth dispensing of the erasing film-tape 4.

The side cases 31 are also provided at their respective lower portions with a forward extended and inward projected elastic strip 315 having a predetermined curved configuration. Each of the elastic strips 315 has a front section that is not connected at an inner edge to an inner surface of the side case 31, enabling the elastic strips 315 to have sufficient elastic tension. Meanwhile, the side cases 31 are provided at rear ends with rearward projected stoppers 316.

Figure 4:
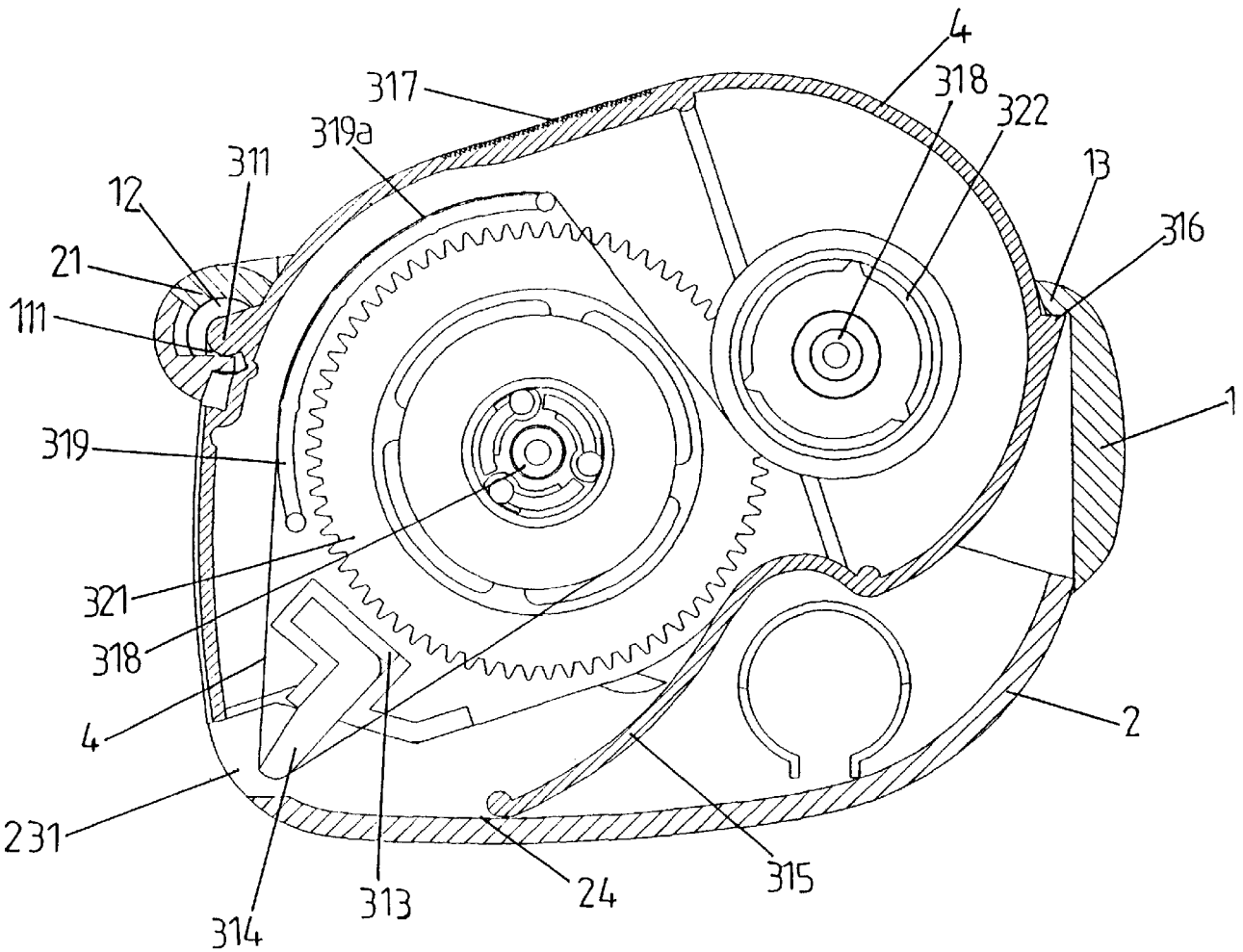
FIG. 4 is a sectioned side view of FIG. 1.

Please refer to FIG. 4 that is an assembled sectioned side view of the film-tape eraser of the present invention. When the dispensing mechanism 3 is mounted in the lower case 2, the elastic strips 315 normally extend their free ends downward to elastically press against the slide way 24 and thereby force the dispensing mechanism 3 to pivotally turn about the shafts 311 to lift a rear portion of the dispensing mechanism 3 until the stoppers 316 at the rear end of the assembled side cases 31 abut against the stopper 13 at the upper rear end of the upper case 1, so that the dispensing mechanism 3 is held in the lower case 2. With the dispensing mechanism 3 held in this lifted position, the dispensing head 314 is in a retracted position to locate behind the dispensing opening 231 without exposing from the lower case 2 and is therefore protected from damage in case of unexpected dropping of the whole film-tape eraser.

Figure 2:
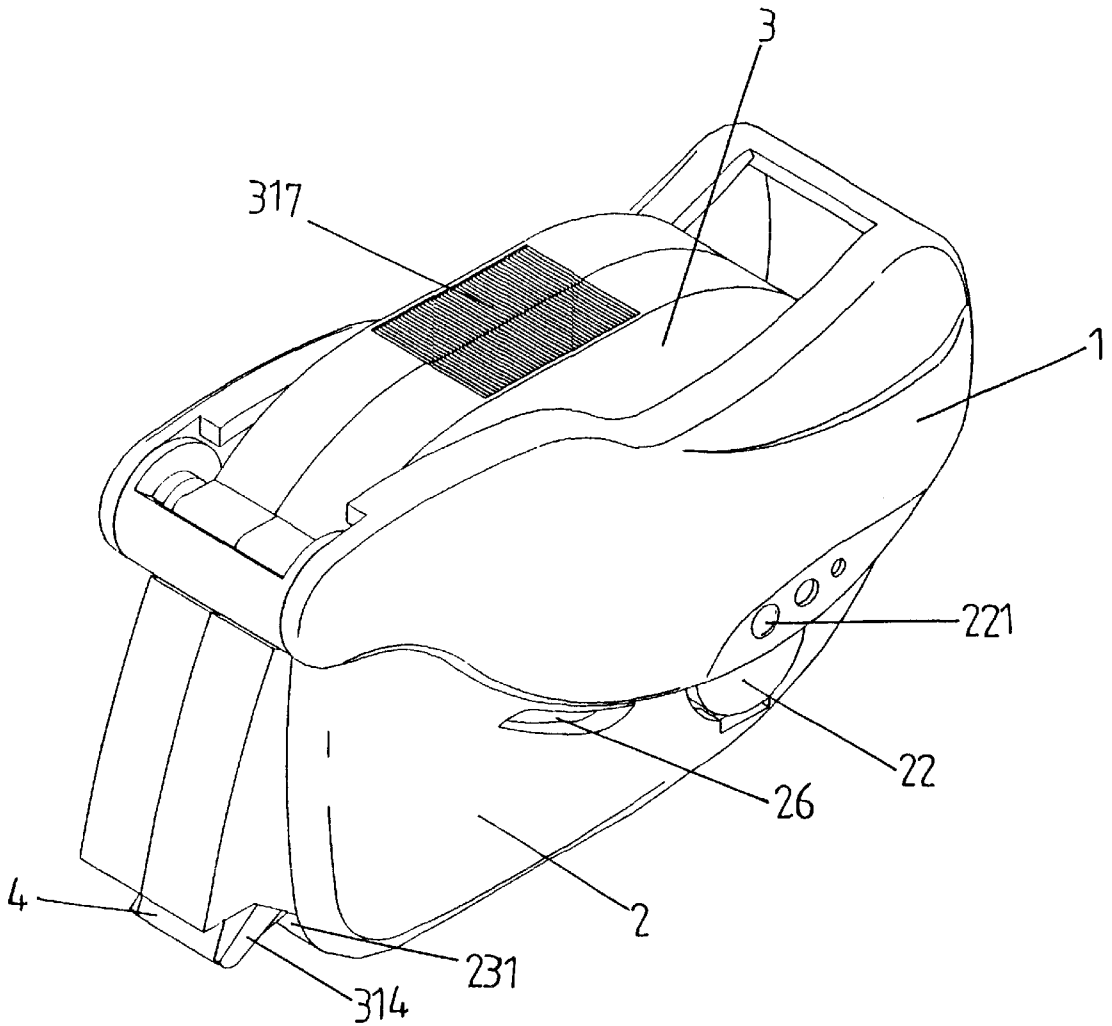
FIG. 2 shows a dispensing mechanism of the film-tape eraser of FIG. 1 is elastically depressed to project the dispensing head from the eraser.
Figure 6:
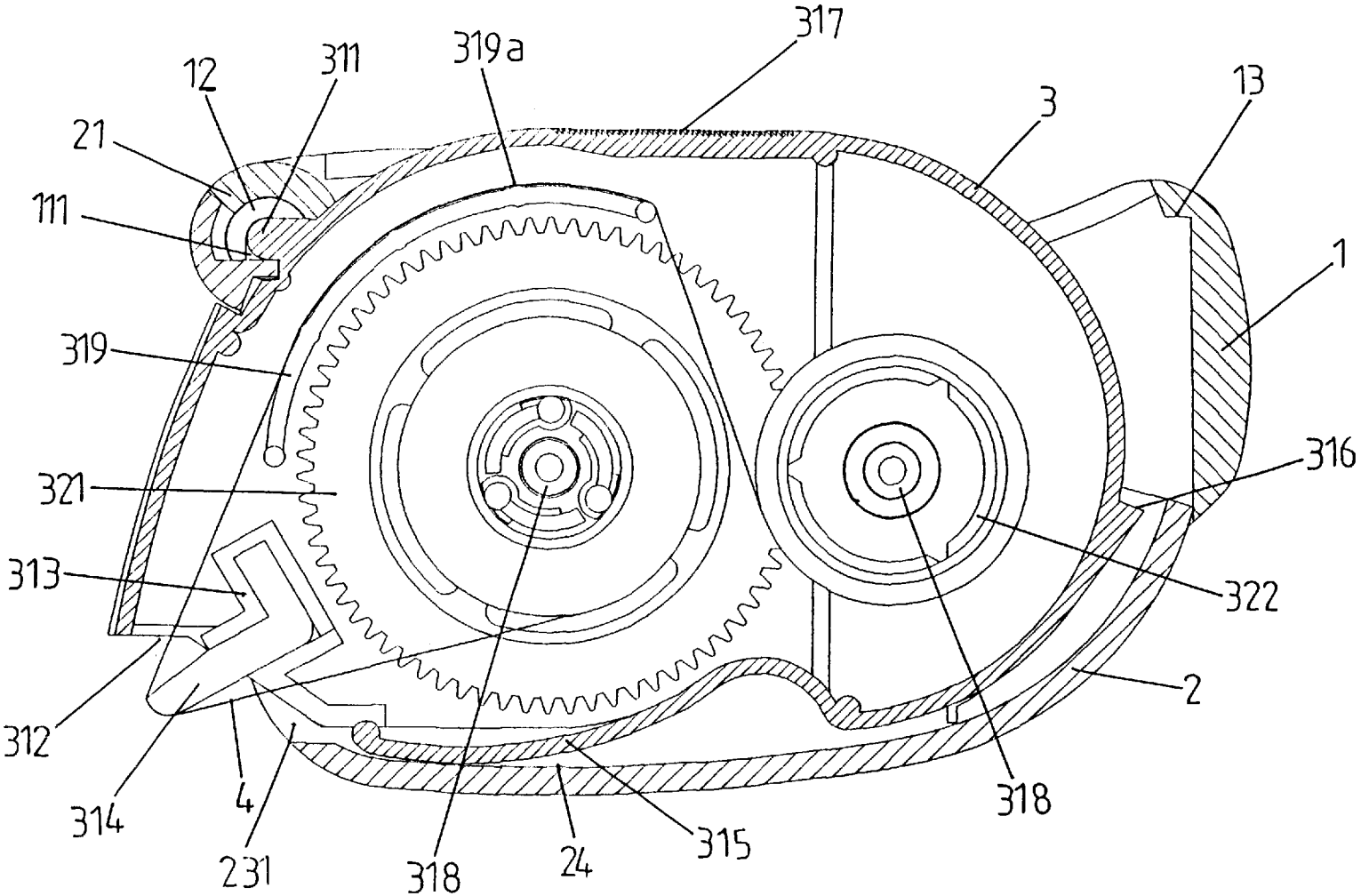
FIG. 6 is a sectioned side view of FIG. 2.

Please refer to FIGS. 2 and 6. When a user downward pushes the dispensing mechanism 3 at the antislip lines 317, the elastic strips 315 are compressed to slide their free ends forward along the slide way 24, allowing the whole dispensing mechanism 3 to sink in the lower case 2. At this point, the dispensing head 314 is brought to a position projected from the dispensing opening 231 for the user to dispense a length of the erasing film-tape 4. After the erasing, the user needs only to release the downward push from the antislip lines 317, the elastic tension of the compressed elastic strips 315 immediately springs the whole dispensing mechanism 3 upward until the stoppers 316 abut against the stopper 13 again. At this point, the dispensing head 314 is brought back to the retracted position in the lower case 2 behind the dispensing opening 231.

Figure 7:
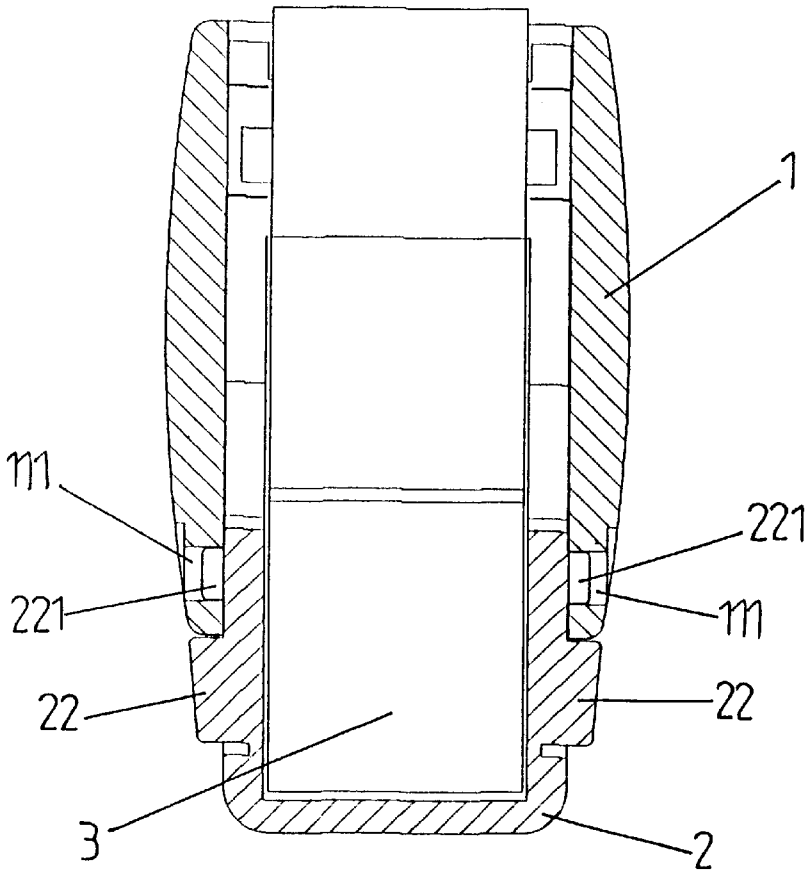
FIG. 7 is a sectioned front view of the film-tape eraser of the present invention.
Figure 8:
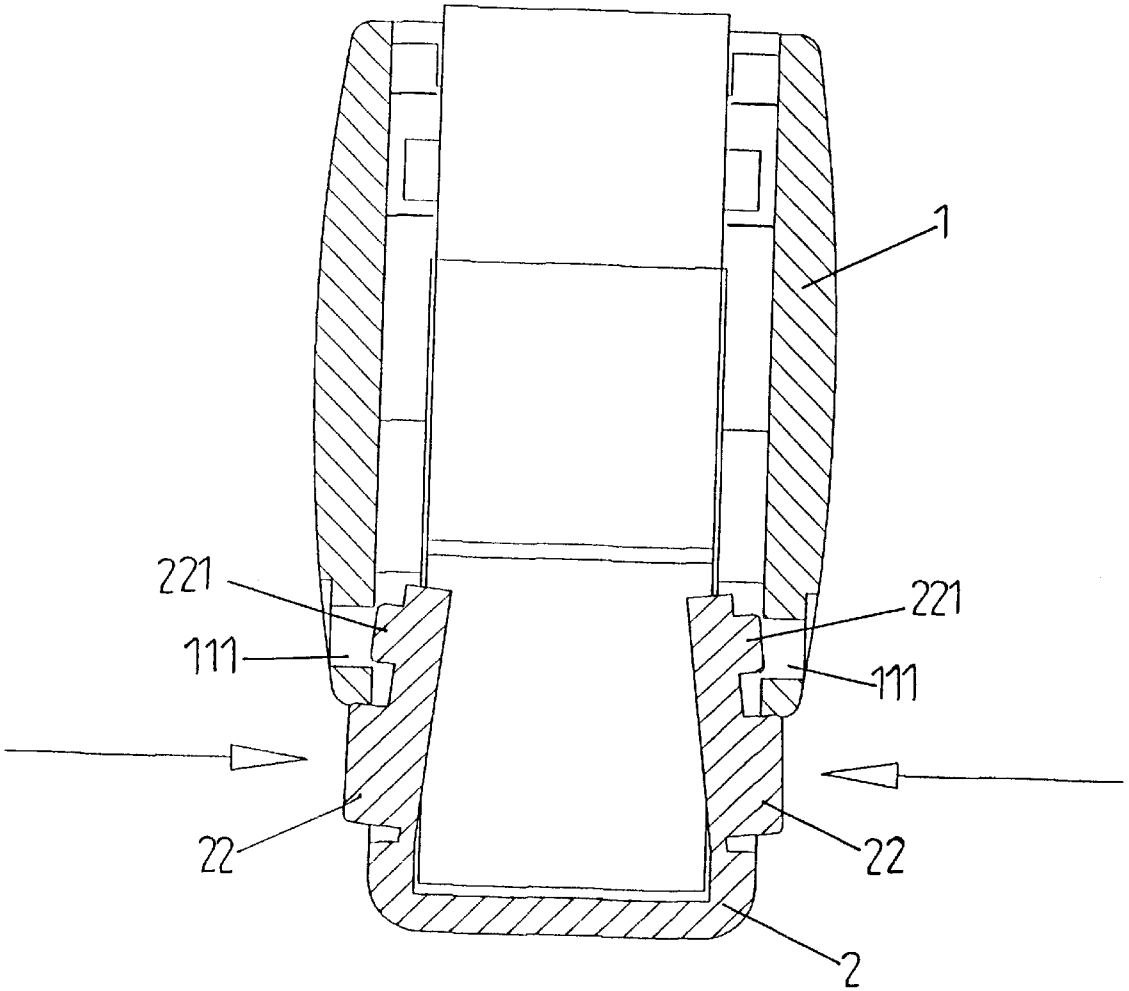
FIG. 8 is a vertical sectional view of the present invention showing release buttons on two sides of a lower case of the eraser are inward pushed to disengage the lower case from an upper case.
Figure 9:
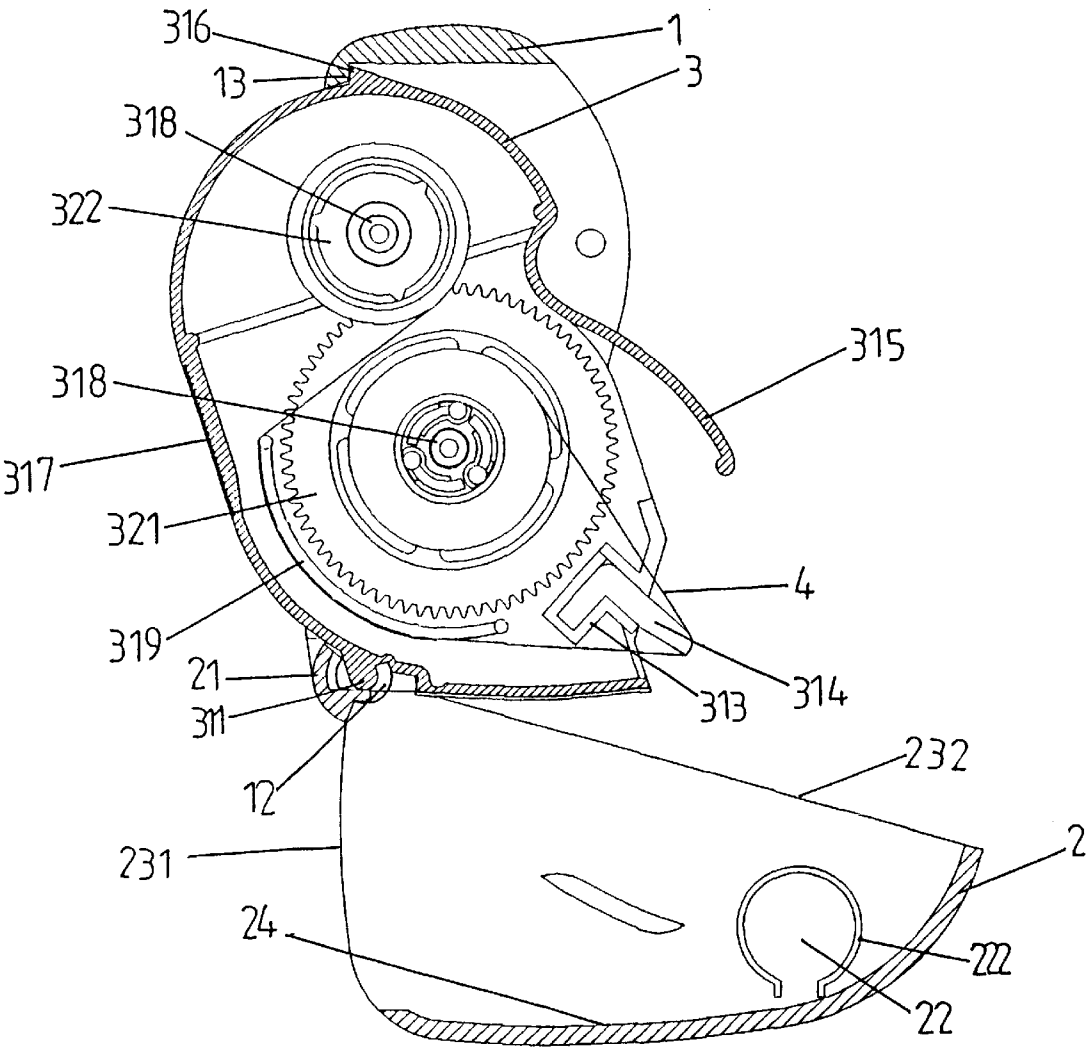
FIG. 9 is a sectioned side view showing the dispensing mechanism and the upper case of the film-tape eraser are pivotally lifted from the lower case.

FIG. 7 is a sectioned front view of the film-tape eraser of the present invention in a normal condition. When a user wants to replace an old erasing film-tape 4 with a new one, he or she needs only to push the two release buttons 22 inward, as indicated by the arrows in FIG. 8, to disengage the locking studs 221 from the locking holes 111 and thereby release the upper case 1 from the lower case 2. At this point, the elastic strips 315 in the lower case 2 pressed against the slide way 24 are no longer subjected to any downward force from the upper case 1, and the elastic tension of the elastic strips 315 immediately springs the whole dispensing mechanism 3 and the upper case 1 up at the same time. The pivot shafts 12 of the upper case 1 are turned to orient the lower openings 122 of the pivoting holes 121 upward, and the user may easily remove the dispensing mechanism 3 from the upper case 1 by disengaging the projected shafts 311 from the pivoting holes 121, and then use a new erasing tape 4 to replace the old one.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A film-tape eraser with normally retracted dispensing head, comprising:

a dispensing mechanism including a case with a dispensing heard located at a lower front of said case, said case having internally mounted an erasing film-tape that passes a front end of said dispensing head, and said case being provided at a bottom with a forward extended elastic strip, and at a rear end with a rearward projected stopper;

a lower case being a hollow member having a front and a top opening for said dispensing mechanism to pivotally locate therein, said lower case being provided at two sidewalls with two release buttons, each of which having a locking stud outwardly projected from an upper part thereof, and said lower case including a bottom that serves as a slide way, against which a front free end of said elastic strip of said dispensing mechanism is elastically pressed to normally upward push said dispensing mechanism into a lifted position in said lower case; and an upper case being pivotally connected to said lower case to shield an upper part of said lower case, said upper case being provided at two sidewalls near lower rear portions thereof with two locking holes for engaging with said locking studs on two sidewalls of said lower case, and at an upper rear end with a forward projected stopper, against which said rearward projected stopper on said case of said dispensing mechanism is abutted to restrict said dispensing mechanism in said lower case with said dispensing head located in said lower case;

whereby when said case of said dispensing mechanism is downward pushed at a top thereof, said dispensing mechanism sinks to compress the front free end of said elastic strip to slide forward along said slide way of said lower case, bringing said dispensing head to expose from said lower case, and when said downward push at the top of said case of said dispensing mechanism is released, an elastic tension of said compressed elastic strip springs said dispensing mechanism upward until said rearward projected stopper abuts against said forward projected stopper on said upper case again, and brings said dispensing head into said lower case.

2. The film-tape eraser with normally retracted dispensing head as claimed in claim 1, wherein said upper case is an n-shaped hollow member having a rear wall and two sidewalls, said sidewalls being provided at front inner ends with two inward projected pivot shafts, to which said lower case is turnably connected; and said two pivot shafts being provided with two open-bottomed pivoting holes, to which said dispensing mechanism is pivotally connected.

3. The film-tape eraser with normally retracted dispensing head as claimed in claim 2, wherein said lower case includes a connecting part extended across a joint of said front and said top opening of said lower case, and two lateral ends of said connecting part being formed into two shaft rings defining two shaft holes, with which said pivot shafts on said upper case are rotatably engaged to allow said upper case to turn to a lifted position to locate above said lower case or a lowered position to partially shield said lower case.

4. The film-tape eraser with normally retracted dispensing head as claimed in claim 2, wherein said case of said dispensing mechanism is provided at two sides of an upper front thereof with two outward projected shafts for pivotally connecting to said open-bottomed pivoting holes of said upper case.

* * * * *